United States Patent [19]

Nichols et al.

[11] Patent Number: 4,601,298

[45] Date of Patent: Jul. 22, 1986

[54] FILTER CIGARETTE

[75] Inventors: Walter A. Nichols; Reginald W. Newsome, both of Richmond, Va.

[73] Assignee: Philip Morris Incorporated, New York, N.Y.

[21] Appl. No.: 691,052

[22] Filed: Jan. 14, 1985

[51] Int. Cl.[4] ..... A24B 3/04

[52] U.S. Cl. ..... 131/336; 131/198.2

[58] Field of Search ..... 131/336, 331, 337, 339, 131/340, 344, 198.2, 198.1

[56] References Cited

U.S. PATENT DOCUMENTS

| | | | |
|---|---|---|---|
| 3,327,718 | 6/1967 | Kilburn | 131/331 |
| 3,359,988 | 12/1967 | Thomson | 131/331 |
| 3,376,874 | 4/1968 | Kim et al. | 131/331 |
| 3,428,050 | 2/1969 | Kandel | 131/331 |
| 3,503,406 | 3/1970 | Riegel et al. | 131/331 |
| 3,504,678 | 4/1970 | Pitt | 131/331 |
| 3,512,537 | 5/1970 | Pelletier | 131/331 |
| 3,608,561 | 9/1971 | Dock | 131/336 |
| 3,738,375 | 6/1973 | Doumas | 131/331 |
| 3,789,855 | 2/1974 | Norman | 131/331 |
| 4,340,074 | 7/1982 | Tudor | 131/362 |

FOREIGN PATENT DOCUMENTS

| | | |
|---|---|---|
| 0105683 | 4/1984 | European Pat. Off. . |
| 1782545 | 9/1971 | Fed. Rep. of Germany . |
| 84/01273 | 4/1984 | PCT Int'l Appl. . |
| 1058343 | 2/1967 | United Kingdom . |
| 1446472 | 8/1976 | United Kingdom . |
| 2099678 | 12/1982 | United Kingdom . |

*Primary Examiner*—V. Millin

*Attorney, Agent, or Firm*—Jeffrey H. Ingerman

[57] ABSTRACT

A filter cigarette is provided which comprises a tobacco rod which includes a charge of tobacco wrapped in cigarette paper, an integral, axially aligned wrapped cylindrical filter plug, and tipping paper. The filter plug is divided into first and second segments with the first segment being rotatable with respect to the second segment. Rotation of the first segment with respect to the second segment causes axial movement of the first segment which serves to vary the air dilution value of the cigarette by uncovering a permeable region in the plug wrapping.

10 Claims, 7 Drawing Figures

FILTER CIGARETTE

BACKGROUND OF THE INVENTION

The present invention relates to filter cigarettes. More particularly, the present invention relates to filter cigarettes which are adjustable by the smoker to vary the air dilution value of the cigarette. The air dilution value is the ratio of the volume of air to the volume of smoke exiting the mouth end of the cigarette and is expressed as a percentage.

Various mechanisms have been disclosed in heretofore issued patents which provide for adjustment of the air dilution value of a filter cigarette, but these mechanisms are not without certain disadvantages. While many complicated mechanisms have been disclosed, the simpler mechanisms generally involved making one or more openings in a substantially air impermeable filter plug wrap and the overlying, substantially air impermeable tipping paper. A sleeve containing one or more corresponding openings is placed over the tipping paper and is then either rotated or moved axially to select the degree to which the two sets of openings are in registry. In another embodiment found in the art, the filter is not glued to the tipping paper and thus may be moved axially within the cylinder formed by the tipping paper. Openings are made in the tipping paper which correspond to openings made in the filter plug wrap. The air dilution value is adjusted by axially moving the filter plug within the tipping paper to adjust the degree to which the two set of openings are in registry.

Among the problems associated with such mechanisms are that the sleeve or the filter plug may be removed from the cigarette by the smoker and not readily replaced. Also, registry between the two sets of openings may be inadvertently destroyed by a slight axial movement of the sleeve or plug. Accordingly, the air dilution value selected by the smoker is not insured of any degree of consistency. Yet another problem associated with a number of these prior devices is that they have not been readily adaptable to a high rate of production on cigarette making machinery of conventional design.

In copending, commonly-assigned application Ser. No. 429,392, filed Sept. 30, 1982 now U.S. Pat. No. 4,532,943, a filter cigarette is described which comprises a tobacco rod, that is, a charge of tobacco wrapped in cigarette paper, attached to an axially aligned, wrapped cylindrical filter plug, and tipping paper. The filter has a mouth end and a rod end, both of which are open to permit passage of air and smoke, and is divided into first and second segments by a circumferentially extending cut which defines a central, axial core about which the first segment can be rotated relative to the second segment. The tipping paper circumscribes and joins the filter plug to the tobacco rod in abutting end-to-end relation, and extends from substantially the mouth end of the filter plug to a point on the tobacco rod adjacent the rod end of the filter plug and has a perforated break line at a point between the circumferential cut and the tobacco rod.

At least one opening is made through the tipping paper and the underlying portion of the filter plug wrap, such that, as the first segment of the filter is rotated about the axis of the central core, the opening in the tipping paper and the opening in the underlying portion of the plug wrap are in varying degrees of registry to permit varying amounts of air to enter the filter and combine with the smoke, thereby varying the air dilution value of the cigarette.

Although the cigarette described in said application eliminates the above-described shortcomings of previously known dilution-varying mechanisms, additional operations are required to form the circumferential cut in the filter, the break line in the tipping paper, and the openings in the tipping paper and the plug wrap when manufacturing the cigarette on conventional cigarette making equipment.

Accordingly, it is an object of the present invention to provide a filter cigarette, which can be manufactured readily with as few additional operations as possible on conventional cigarette making equipment, and that is adjustable by the smoker to vary the air dilution value of the cigarette.

SUMMARY OF THE INVENTION

A filter cigarette is provided which comprises a tobacco rod, a substantially cylindrical wrapped filter plug, and tipping paper circumscribing the filter plug and joining it to the tobacco rod. At least one of the tipping paper and the plug wrapping is preferably substantially air impermeable. The filter plug has a mouth-end segment and a rod-end segment of filter tow material axially connected to one another for relative axial rotation such that the segments move toward and away from each other as they are rotated. The tipping paper extends from the mouth end of the filter plug to a point on the tobacco rod adjacent the filter plug, and has a break-away zone overlying the rod-end segment. The plug wrapping is air permeable at least in the region underlying the break-away zone, such that as the filter segments are rotated, the mouth-end segment of the filter moves toward the rod-end segment, carrying with it that portion of the tipping paper between the mouth end of the cigarette and the break-away zone. The underlying air permeable region of the plug wrapping is exposed in varying amounts depending on the degree of rotation, thereby varying the air dilution value of the cigarette.

The cigarettes of the present invention may be manufactured employing conventional equipment with only minor modifications.

BRIEF DESCRIPTION OF THE DRAWINGS

The present invention will now be described with reference to the following drawings in which like elements are given like reference numbers throughout, and in which.

DESCRIPTION OF THE PREFERRED EMBODIMENT

Figure 1A:
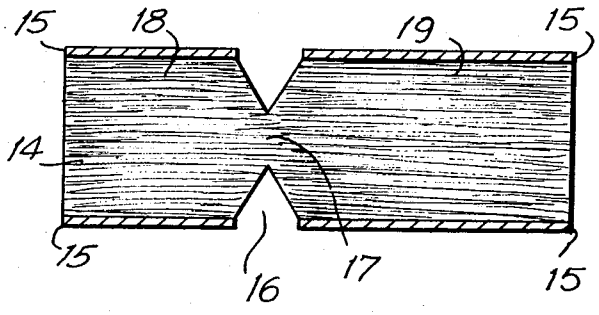
FIG. 1A is a longitudinal cross-sectional view taken from line 1A—1A of FIG. 1.
Figure 1:
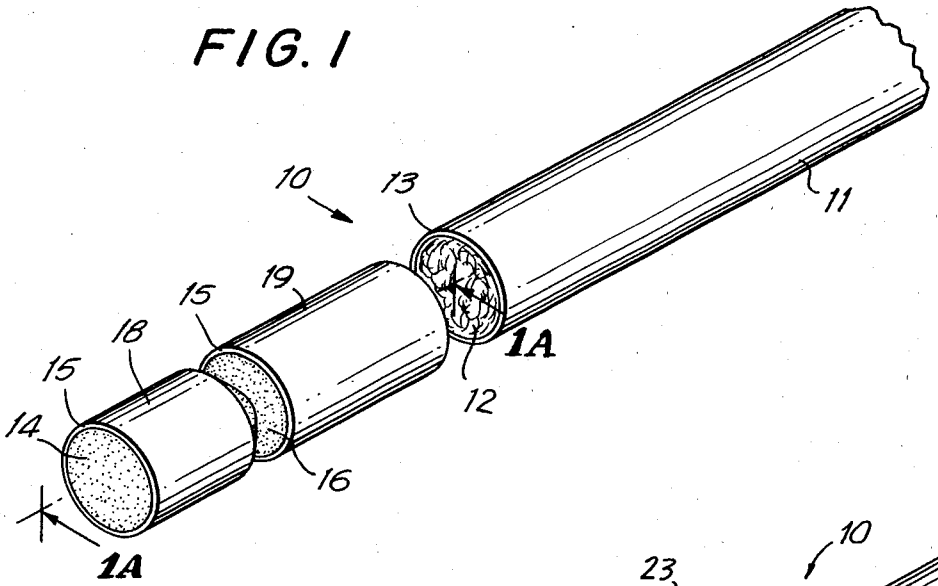
FIG. 1 is an enlarged fragmentary perspective view of the filter plug and tobacco rod of the filter cigarette of the present invention taken from the mouth end.
Figure 2:
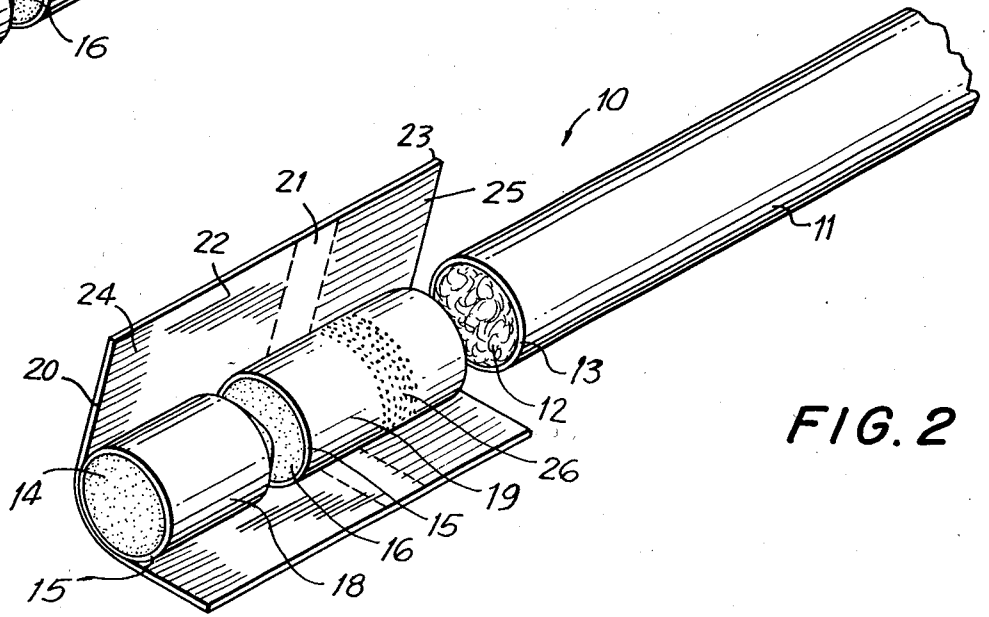
FIG. 2 is a fragmentary perspective view of the filter cigarette of the present invention taken from the mouth end and showing the tobacco rod, filter, and tipping paper as well as the break-away zone provided through the tipping paper to provide for variable dilution.
Figure 3:
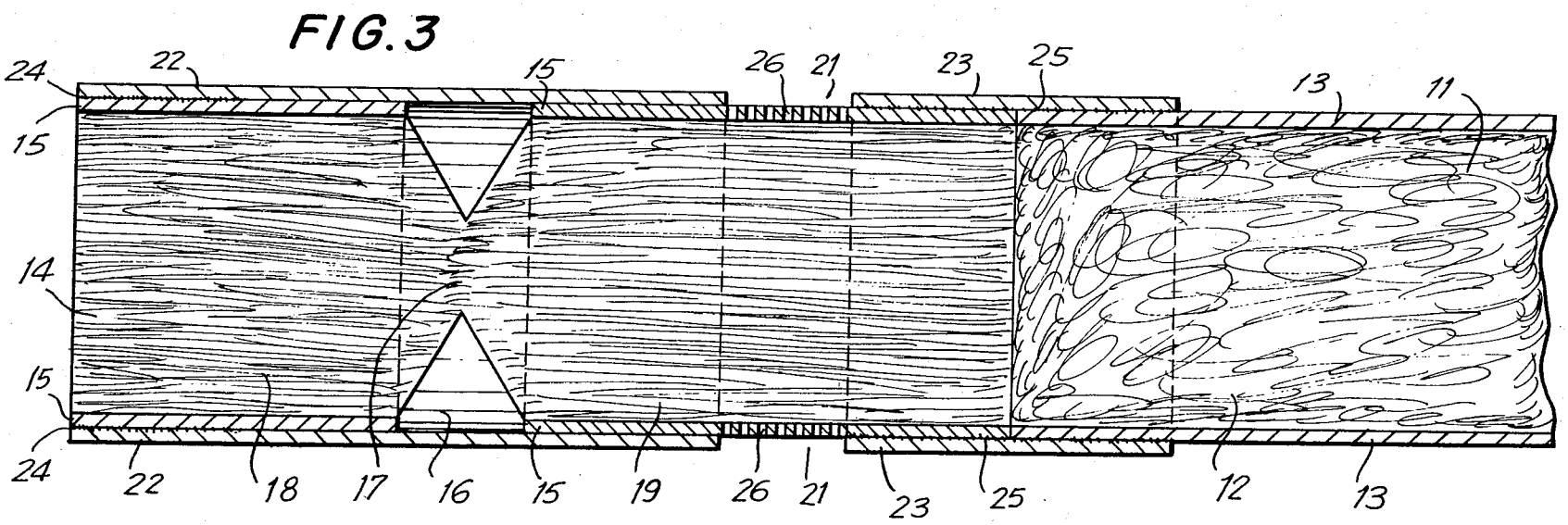
FIG. 3 is a longitudinal cross-sectional view of one embodiment of the filter cigarette of the present invention at its maximum air dilution value.
Figure 4:
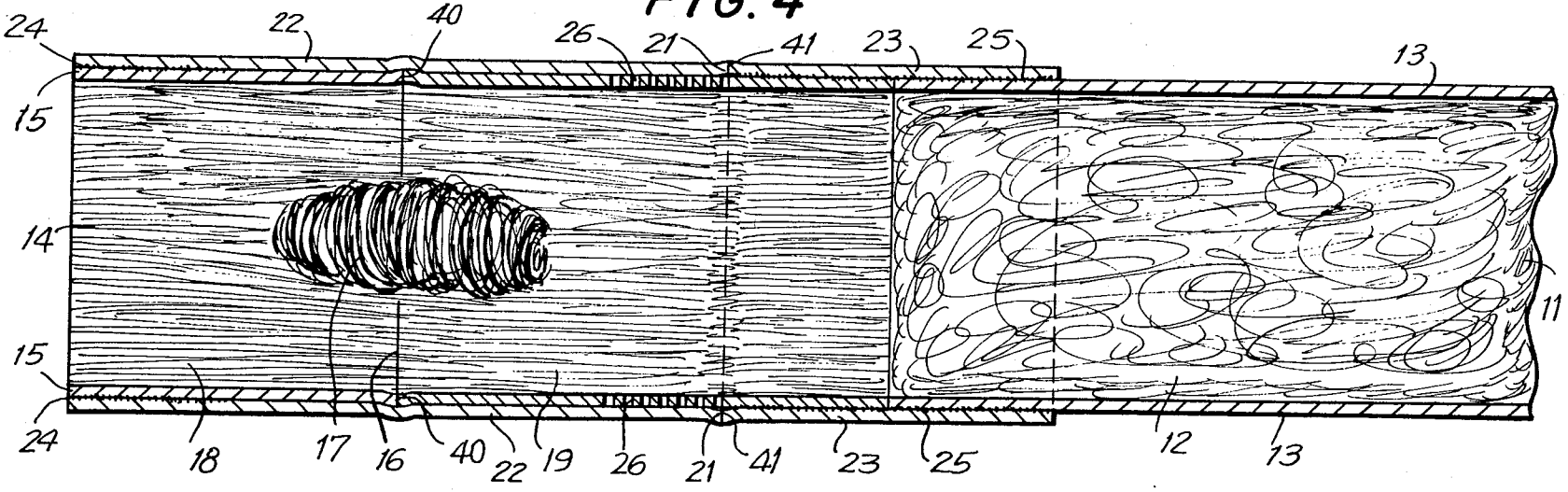
FIG. 4 is a longitudinal cross-sectional view of the embodiment of FIG. 3 at its minimum air dilution value.
Figure 5:
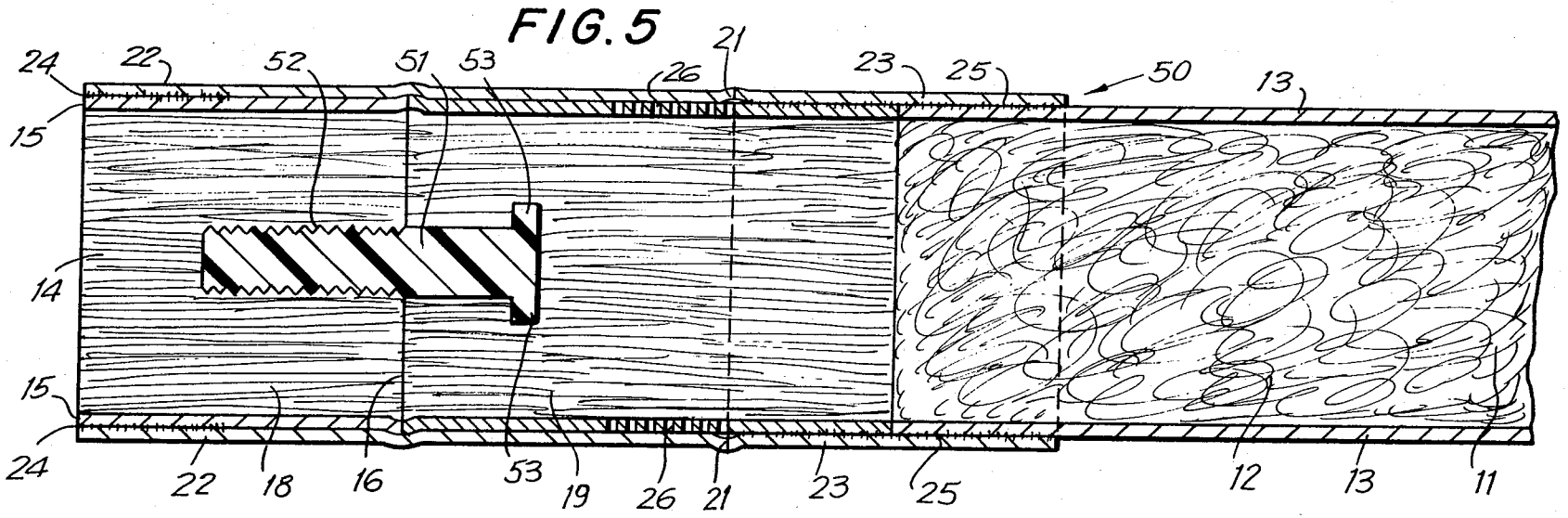
FIG. 5 is a longitudinal cross-sectional view of a second embodiment of the cigarette of the present invention at its minimum air dilution value.
Figure 6:
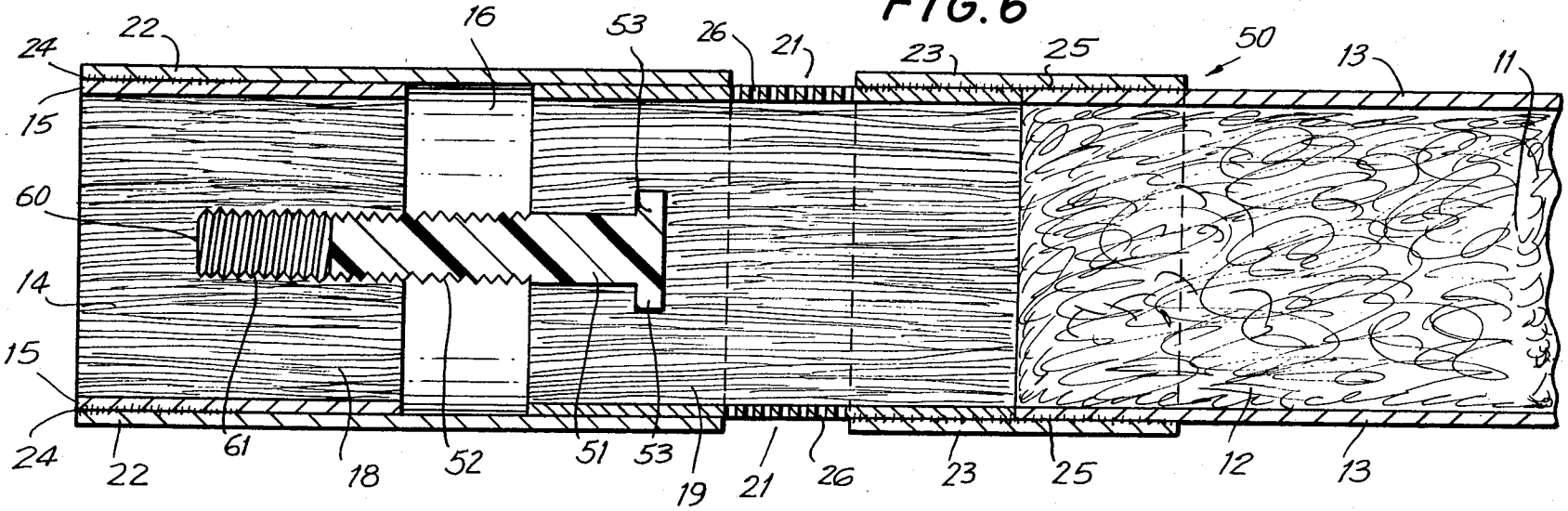
FIG. 6 is a longitudinal cross-sectional view of the embodiment of FIG. 5 at its maximum air dilution value.

A Preferred embodiment of the variable dilution cigarette 10 of the present invention is shown in FIGS. 1–4 and comprises a tobacco rod 11 which is a substantially cylindrical charge of tobacco 12 wrapped in a cigarette paper 13. The tobacco rod is joined in abutting end-to-end relation to a filter plug 14 which is circumscribed by plug wrapping 15 and has a circumferentially extending cut 16 intermediate the mouth end and the tobacco rod end defining a central axial core 17, as shown in FIGS. 1A, 3, and 4, and which divides the filter plug into a first mouth-end segment 18 and a second rod-end segment 19.

The filter plug may be any conventional, substantially cylindrical filter such as a cellulose acetate filter or the like. The filter material can be of uniform density or it can contain a substantially cylindrical axial core of relatively high density filter material circumscribed by filter material of relatively lower density. When it is desired to use the nonuniform density filter plug, the higher density filter material preferably forms the axial core 17.

The filter plug and a portion of the mouth end of the tobacco rod are circumscribed in this embodiment by non-porous tipping paper 20. Tipping paper 20 has a circumferentially extending break-away zone 21 which overlies the second segment 19 of the filter plug 14 adjacent the mouth end of the tobacco rod 11. This break-away zone divides the tipping paper 20 into a first mouth-end band 22 and a second rod-end band 23.

The inner surface of the band 22 is attached adjacent the mouth end to the first segment 18 of the filter plug 14, preferably by means of an adhesive band 24. The inner surface of band 23 joins the second segment 19 of the filter plug 14 to the mouth end of the tobacco rod 11, preferably by means of a band of adhesive 25 extending, in width, between the break-away zone 21 and the rod end of band 23.

In this embodiment, break-away zone 21 is best formed after tipping paper 20 is applied to cigarette 10. Break-away zone 21 can be formed by perforating tipping paper 20 in two closely spaced parallel lines preferably before it is applied to cigarette 10, and then removing the material between the lines after tipping paper 20 is applied to cigarette 10. Alternatively, a laser can be used to vaporize a narrow band of tipping paper, plug wrapping and some filter tow material after tipping paper 20 has been applied to cigarette 10. Preferably no filter tow material is removed from filter plug 14.

After break-away zone 21 has been formed, band 22 and the segment 18 are free to rotate in unison about the central core 17. This core 17 will typically have a diameter, in the case of a conventional cellulose acetate filter plug, within the range of from about 12.7% to about 38.1% of the diameter of the filter plug, a value of about 25.4% being preferable. This range will permit segment 18 to be rotated 360° without breaking the core 17. Rotation of band 22 causes core 17 to become twisted and densified, like a rope. The axial length of core 17 thereby decreases, moving segment 18 closer to segment 19, as shown in FIG. 4. Plug wrapping 15 is air permeable in the region underlying the break-away zone 21. The wrapping 15 can either be made of an air impermeable sheet material which is perforated in the region underlying break-away zone 21 as shown at 26, or of an air permeable sheet material. As segment 18 moves toward and away from segment 19, the size of break-away zone 21, and consequently the amount of permeable region 26 which is exposed, varies, thereby varying the air dilution value of the cigarette.

The maximum air dilution value is achieved when core 17 is in its relaxed condition as shown in FIG. 3, and is limited by the respective widths of break-away zone 21 and permeable zone 26. The minimum air dilution value is achieved when core 17 is twisted and segments 18 and 19 are in compressive contact and cannot be moved closer to one another. This condition is shown in FIG. 4, where the segments 18, 19 are bulging at 40 (exaggerated) because of the compressive contact between them. As shown in FIG. 4, the variable components of the air dilution value is zero (although there could be an invariable component of dilution as well so that the total dilution value may be non-zero), because bands 22, 23 are also in compressive contact, as indicated by the bulge at 41 (exaggerated). However, it is possible to make break-away zone 21 larger, so that segments 18, 19 come into compressive contact before bands 22, 23, resulting in a non-zero minimum value of the variable air dilution component. In such a case, bands 22, 23 are prevented from contacting one another both by the compressive contact of segments 18, 19 and by the limit to the number of turns of segment 18 relative to segment 19 that can be made without tearing core 17, which in turn limits how close the segments, and therefore the bands, can be moved together.

It should be understood that from the position of maximum dilution, in which core 17 is relaxed, segment 18 can be rotated either clockwise or counterclockwise to move toward the position of minimum dilution. From the position of minimum dilution or from an intermediate position, the direction of rotation needed to increase or decrease dilution is dependent on the direction in which segment 18 was initially rotated from the maximum dilution position.

Means for permitting the smoker to select a specific air dilution ratio may be provided through indicia (not shown) printed on the plug wrapping 15 in the region 26 which are designed to show, by the number thereof which are visible, the degree to which region 26 is exposed. Alternatively, plug wrapping 15, or that portion of plug wrapping 15 in region 26, can be colored differently than tipping paper 20, the degree of dilution being shown by the width of that portion of the colored band that is visible.

A second preferred embodiment 50 is constructed like the first preferred embodiment 10, except that circumferential cut 16 completely severs filter plug 14 into two separate segments 18, 19. Segments 18, 19 are connected, rather than by axial core 17, by a threaded axial plastic insert 51, which is inserted into a cavity 60 in filter plug 14 during its formation. That portion of insert 51 in segment 19 is preferably not threaded, but is rather anchored to segment 19 either by cement or by anchoring projections 53, while that portion in segment 18 has threads 52 which mate with threads 61 in segment 18.

The operation of second embodiment 50 is basically the same as that of first embodiment 10, except that in second embodiment 50 the axial movement of segment 18 toward and away from segment 19 is caused by threads 52, 61, and therefore rotation in a given direction will always cause axial movement in one direction. The same type of indicia (not shown) can be provided on second embodiment 50 as on first embodiment 10 to indicate the degree of dilution. In addition, because it is possible to screw segment 18 completely off insert 51, it is desirable to print a colored band on plug wrapping 15 at the mouth end of region 26 to provide a visible warning that segment 18 should not be screwed out any further. If the color band form of dilution indicia is used, the dilution-indicating band should be a different color than the warning band.

In second embodiment 50, the "relaxed" position of the filter is that in which segments 18, 19 are touching, unlike the relaxed position of first embodiment 10. Therefore, when manufacturing second embodiment 50, tipping paper 20 can be provided with break-away zone 21, which need only be a circumferential slit, by laser or mechanical cutting after assembly, or by laser or mechanical perforation before or after assembly. If perforations are used, they need not be broken until the smoker desires to rotate segment 18, so that the cigarettes can be packed and shipped with the perforations intact. This results in a more rigid cigarette which can better withstand shipping and handling.

In first embodiment 10, the densification of core 17 affects the resistance-to-draw of the filter plug 14, which introduces another variable into the air dilution value of the cigarette. In second embodiment 50, the "core" 51 is permanently "densified," so that it does not affect the dilution-varying mechanism. These differences can be taken into account when making the cigarette, and compensated for by adjusting the permeability of plug wrapping 15 and tipping paper 20, or by adjusting the number of perforations in region 26.

In an alternative embodiment using either the axial core of the threaded axial plastic insert, tipping paper 20 can be air permeable, while plug wrapping 15 is impermeable and is perforated at 26. In this embodiment, some air will be able to enter that portion of region 26 which is covered by tipping paper 20, providing a non-zero minimum dilution value, but if the permeability of tipping paper 20 is chosen carefully—i.e., low enough, the incremental controllable amount of air that can enter through break-away zone 21 will be great enough for the variable dilution component to be noticeable. If air permeable tipping paper is used, plug wrapping 15 could also be air permeable but preferably should be air impermeable, otherwise air could enter along the entire filter plug, rendering a lesser degree of control over the dilution value.

The cigarettes of the present invention may be readily produced on conventional cigarette making and tipping apparatus with a miniumum of modification. Forming and cutting the cigarette rod and the filter plug to length are done conventionally. Also, bringing the filter plug into axial alignment with the cigarette rod and the overwrapping with tipping paper are accomplished in the same manner as in the manufacture of conventional cigarettes. The formation of break-away zone 21 in the tipping paper can be done either before or after the cigarette is assembled, as described above, depending on which embodiment of the cigarette is being made.

What is claimed is:

1. A filter cigarette comprising a tobacco rod, a substantially cylindrical filter plug, a plug wrapping circumscribing said filter plug, and tipping paper overlying said plug wrapping and circumscribing and joining said filter plug and a portion of said tobacco rod, said filter plug comprising a mouth-end segment of filter tow material axially connected to a rod-end segment of filter tow material for relative rotation about the axis of the cigarette such that said rotation causes said mouth-end segment to move axially between a first position axially spaced from said rod-end segment and a second position in compressive contact with said rod-end segment, said tipping paper comprising, in axial sequence, first and second bands, said first band extending from a first point on said rod-end segment to a point on said tobacco rod and fixedly connecting said tobacco rod to said rod-end segment, and said second band being fixed to said mouth-end segment and extending axially to a second point on said rod-end segment, said second point being closer to said mouth-end segment than said first point, said second band being spaced axially from said first band when said mouth-end segment is in said first position and axially abutting said first band when said mouth-end segment is in said second position, said plug wrapping being air permeable in at least a region between said first and second points, said axial movement of said mouth-end segment carrying said second band toward and away from said first band, thereby exposing varying amounts of said air permeable region of said plug wrapping, thereby varying the air dilution value of said filter cigarette.

2. The filter cigarette of claim 1 wherein said plug wrapping comprises an air permeable material.

3. The filter cigarette of claim 2 where said tipping paper is substantially air impermeable.

4. The filter cigarette of claim 2 wherein said tipping paper is air permeable.

5. The filter cigarette of claim 1 wherein said plug wrapping comprises a substantially air impermeable material and is perforated in said air permeable region.

6. The filter cigarette of claim 5 wherein said tipping paper is substantially air impermeable.

7. The filter cigarette of claim 5 wherein said tipping paper is air permeable.

8. The filter cigarette of claim 1 wherein said mouth-end segment and said rod-end segment are defined by a circumferential cut in said filter plug.

9. The filter cigarette of claim 8 wherein said cut extends partially through said filter plug and defines a central axial core of filter tow material connecting said segments, said mouth-end segment being in said first position when said central axial core is relaxed, said relative rotation of said segments in a first direction from the position in which said core is relaxed causing densification and shortening of said core so that said mouth-end segment moves to said second position, and rotation of said segments in a second direction from the position in which said core is densified causes relaxation and lengthening of said core so that said mouth-end segment returns to said first position.

10. The filter cigarette of claim 8 wherein said segments are connected by a threaded axial plastic insert, said insert extending into each of said segments of filter tow material.

* * * * *